US005143106A

United States Patent [19]

Bannon

[11] Patent Number: 5,143,106

[45] Date of Patent: Sep. 1, 1992

[54] ULTRASONIC PARTS CLEANING CONTAINER

[76] Inventor: John H. Bannon, 4208 Crownfield Ct., Westlake Village, Calif. 91361

[21] Appl. No.: 806,699

[22] Filed: Dec. 12, 1991

Related U.S. Application Data

[62] Division of Ser. No. 650,242, Feb. 4, 1991, Pat. No. 5,088,510.

[51] Int. Cl.[5] ..... B08B 3/10

[52] U.S. Cl. ..... 134/184; 134/902; 134/135; 310/354

[58] Field of Search ..... 134/135, 147, 901, 1, 134/184, 90, 89; 68/355; 310/348, 354; 366/111, 127

[56] References Cited

U.S. PATENT DOCUMENTS 1,323,989 12/1919 Kline ..... 134/184
2,495,159 1/1950 Chertoff ..... 68/355
2,828,114 3/1958 Raudszus ..... 68/355
3,039,842 6/1962 Hajos ..... 68/355

FOREIGN PATENT DOCUMENTS 1102562 10/1955 France ..... 134/184

*Primary Examiner*—Frankie L. Stinson
*Attorney, Agent, or Firm*—Jack C. Munro

[57] ABSTRACT

A parts container to be utilized within the liquid cleaning solution of an ultrasonic bath which is to be formed within an enclosing side wall having an open top and an enclosed bottom. Mounted within the enclosing side wall are a plurality of ultrasonic transducers which are to supply energy from an ultrasonic generator (not shown). The ultrasonic transducers may have an energy emitting cone which functions to emit the ultrasonic energy in a narrow beam. Each of the transducers are adjustably mounted in the side wall so as to be able to manually select the direction of the narrow beam. Also, each transducer could be gimbally mounted on a freely wobbling plate so the transducer energy could randomly sweep across the parts that are being cleaned.

1 Claim, 3 Drawing Sheets

ULTRASONIC PARTS CLEANING CONTAINER

REFERENCE TO PRIOR APPLICATION

This application is a Divisional of U.S. patent application Ser. No. 07/650,242, filed Feb. 4, 1991 by the same title and now U.S. Pat. No. 5,088,510.

BACKGROUND OF THE INVENTION

The field of this invention relates to cleaning devices and more particularly to a container adapted to contain a plurality of parts with this container to contain a liquid cleaning solution and ultrasonic energy to be applied to the parts within the cleaning solution to facilitate their cleaning.

The cleaning of parts is vitally used in manufacturing. Parts cleaning is commonly used in the manufacture of electronics, as well as being commonly used in the manufacture of numerous mechanical devices prior to machining, plating, painting or finishing. In order to enhance the cleaning operation, it has been common to utilize ultrasonic energy in conjunction with the bath to agitate the liquid about the part. It has also been common to introduce the ultrasonic energy through the bottom of the tank holding the bath from outside the tank, and similarly to introduce the ultrasonic energy from the inside bottom of the tank. Parts are introduced into the bath in a basket. The mesh or walls of the container attenuate the waves, and reduce greatly the force, the intensity and the resultant effects on the parts to be cleaned. In the past, it has been common to utilize caustic and toxic cleaning solutions to facilitate the cleaning of parts.

In recent years, the usage of any toxic liquid causes environmental concerns. Any fumes from a toxic bath have to now be captured to prevent such from going into the atmosphere. Also, at the time that a toxic bath needs to be discarded, special disposal techniques are required. Therefore, the use of any toxic cleaning solution greatly magnifies the cost of the cleaning operation due to the special handling requirements.

Manufacturers that are now using ultrasonic cleaning baths desire to use safer cleaning solutions. Inherently, safer cleaning solutions are weaker. A common type of a safe cleaning solution would be detergent and water. However, safe cleaning solutions are in most instances not strong enough to satisfactorily (and economically) clean the parts within conventional ultrasonic cleaning baths. There is a need to greatly enhance the ultrasonic energy of the bath so that parts can be cleaned effectively within a reasonable period of time even when using weaker cleaning solutions.

SUMMARY OF THE INVENTION

A parts container adapted to be used within a bath of cleaning solution which takes the form of an open top enclosing sidewall container which is closed at the bottom by a floor. Mounted within the sidewall of the container are a plurality of ultrasonic transducers. The ultrasonic transducers are capable of being adjusted to "point" the transducers to a selected location or locations within the volume defined by the enclosing sidewall generally for the purpose of concentrating the ultrasonic energy at a certain location or locations. In a second embodiment of this invention, the ultrasonic transducers are each to be mounted by a separate gimbal arrangement within the sidewall. During operation of the transducers, the transducers will then freely, randomly move dispersing the ultrasonic energy throughout the volume confined by the sidewall. The movement of the transducers is limited so that the energy output end of the transducers is always directed within the volume defined by the enclosing sidewall.

The main objective of the present invention is to minimize ultrasonic energy losses during cleaning of parts and allowing the use of weaker, non-toxic, biodegradable cleaning solvents.

Another objective of this invention is to concentrate the application of the energy only within the container, minimizing the use of energy, eliminating the losses which occur in normal methods which supply the energy through the wall of the container which attenuates the energy reducing the force and intensity of the cleaning process.

Another objective is to provide for usage of a heater within the container, applying the heat energy only where needed, eliminating heating of an entire bath. However, the use of a heater is deemed to only be an option.

DETAILED DESCRIPTION OF THE SHOWN EMBODIMENTS

Figure 1:
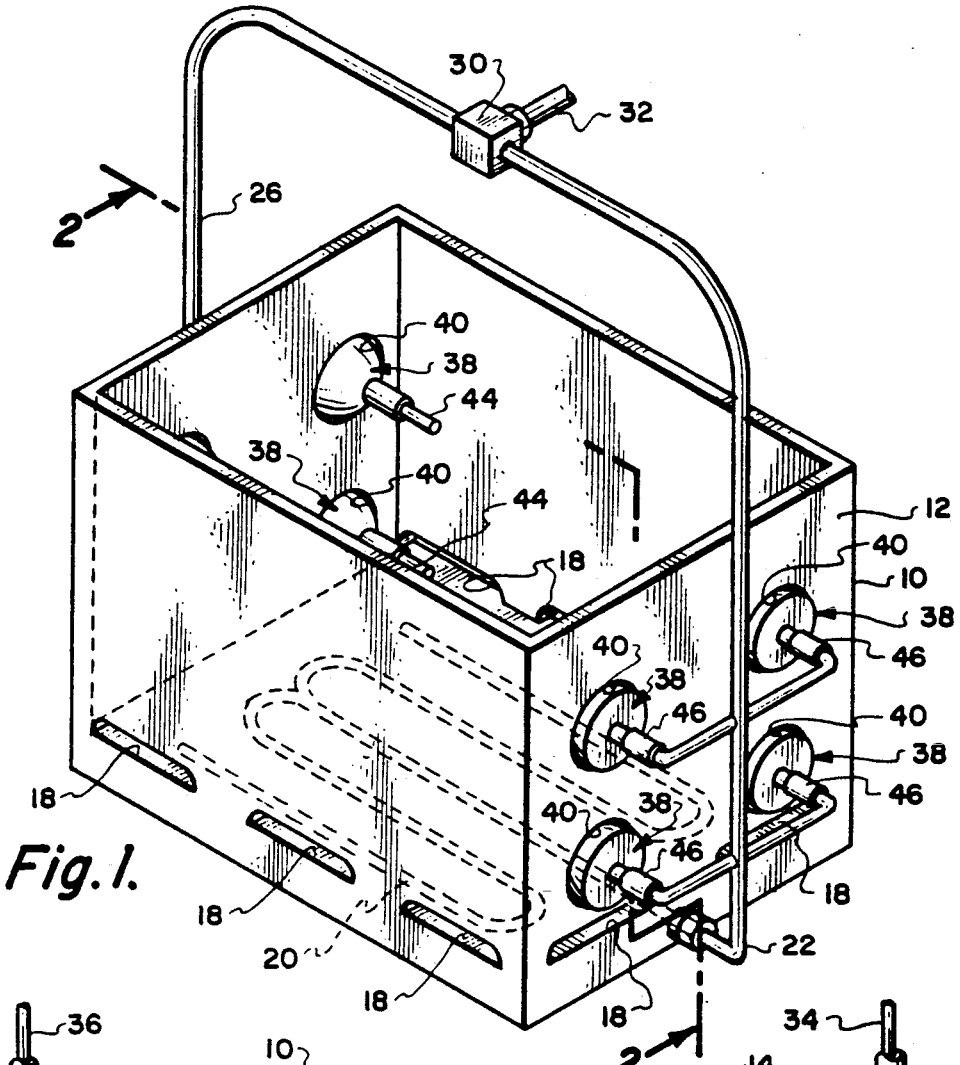
FIG. 1 is an isometric view of the parts container to be submerged within an ultrasonic cleaning bath wherein the ultrasonic transducers can be adjusted to be pointed in a specific direction.
Figure 2:
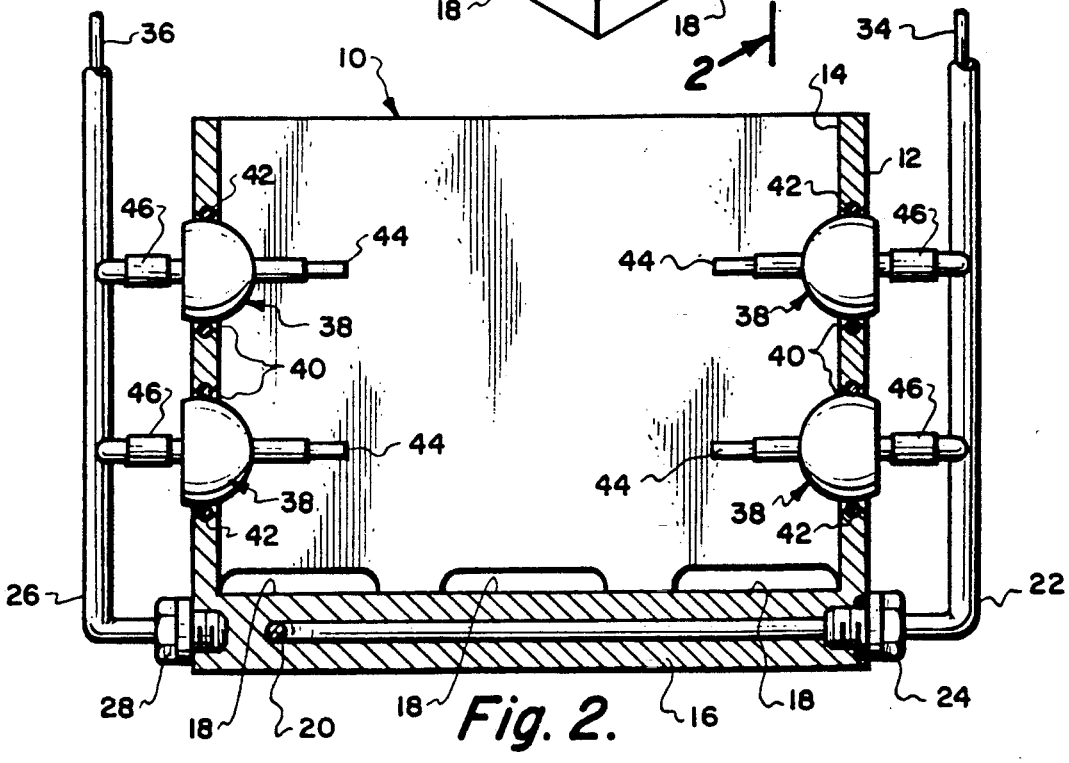
FIG. 2 is a cross-sectional view taken along line 2—2 of FIG. 1.

Referring particularly to FIGS. 1 and 2 of the drawings, there is shown a rectangular shaped box-like parts container 10 which has a rectangularly shaped sidewall 12. Sidewall 12 encloses an interior chamber 14. Interior chamber 14 is open at the top and closed at the bottom by a floor 16. Enclosing sidewall 12, directly adjacent the floor 16, is a series of slots 18 which are to function as drain openings for liquid that is to be contained within the interior chamber 14. Within the floor 16 is located a heating element 20. Heating element 20 is to be supplied electrical energy through conduit 22 which is threadably mounted by means of fitting 24 within the floor 16. Conduit 22 is mounted alongside one end of the container 12 and at the opposite end of the container 12 there is similarly mounted a conduit 26. Conduit 26 is also threadably secured to the floor 16 by means of a fitting 28. The connection of conduit 26 by fitting 28 to floor 16 is strictly for purposes of support and not for the supplying of any electrical energy to the heater coil 20. Only through conduit 22 is electrical energy supplied to heater coil 20.

Conduits 22 and 26 are connected together by means of connector 30. A connecting conduit 32 connects to connector 30. It is through conduit 32 that there is to be supplied the electrical energy into electrical conductor 34, within conduit 22, and electrical conductor 36, within conduit 26. The electrical energy source is not shown and is deemed to be conventional. Actually, conduit 32 will probably be flexible and may be comprised of rubber or plastic Conduits 22 and 26 are to be rigid and are to function as a handle to facilitate lifting of the container. 10. This lifting can be accomplished manually or by means of some type of a lifting apparatus. It is to be understood that the container 10 is to be submerged within a liquid (not shown) within a bath (not shown). The liquid is to be some type of a cleaning solution. Container 10 is to be capable of being moved from bath to bath. Typical baths would be a first cleaning bath, a first rinsing bath, a second cleaning bath, a second rinsing bath, etc.

Mounted within the wall 12 are a plurality of ultrasonic transducers 38. The ultrasonic transducers 38 may be of any known construction. The purpose of the transducers 38 is to set up ultrasonic waves which are transmitted through the liquid within the interior chamber 14. Each of the transducers 38 is mounted within an opening 40 mounted within the sidewall 12. The exterior housing of the transducer 38 is sealed by means of an O-ring seal 42 mounted within the sidewall 12. The O-ring seal 42 is for the purpose of snugly pointing the transducer in position in the sidewall 12 and is not intended to form a liquid tight connection between the exterior housing of the transducer 38 and the sidewall 12. However, there may be inherently produced a liquid tight connection.

Also, the transducer 38 is to be adjustable relative to the sidewall 12. Adjustment is to be achieved manually by merely grasping tip 44 of the transducer 38 and move such to direct the tip 44 in a desired direction. The reason for this is to concentrate the energy coming from the transducer 38 in a particular direction. This adjustment is permitted by means of a flexible section 46 which connects the transducer 38 to the conduit 22.

The purpose of the adjustment of each of the transducers 38 is so that a plurality of the transducers 38 may direct their energy to a given location or locations to facilitate cleaning of a part or parts (not shown) that need "extra cleaning power".

It is to be understood that when the container 12 is removed from within the cleaning solution that the cleaning solution that is contained within interior chamber 14 will be permitted to drain through the drain openings 18 back into the bath. When the interior chamber 14 is empty of the cleaning solution, the container 12 will then be moved to away from the bath to a desired location.

Figure 3:
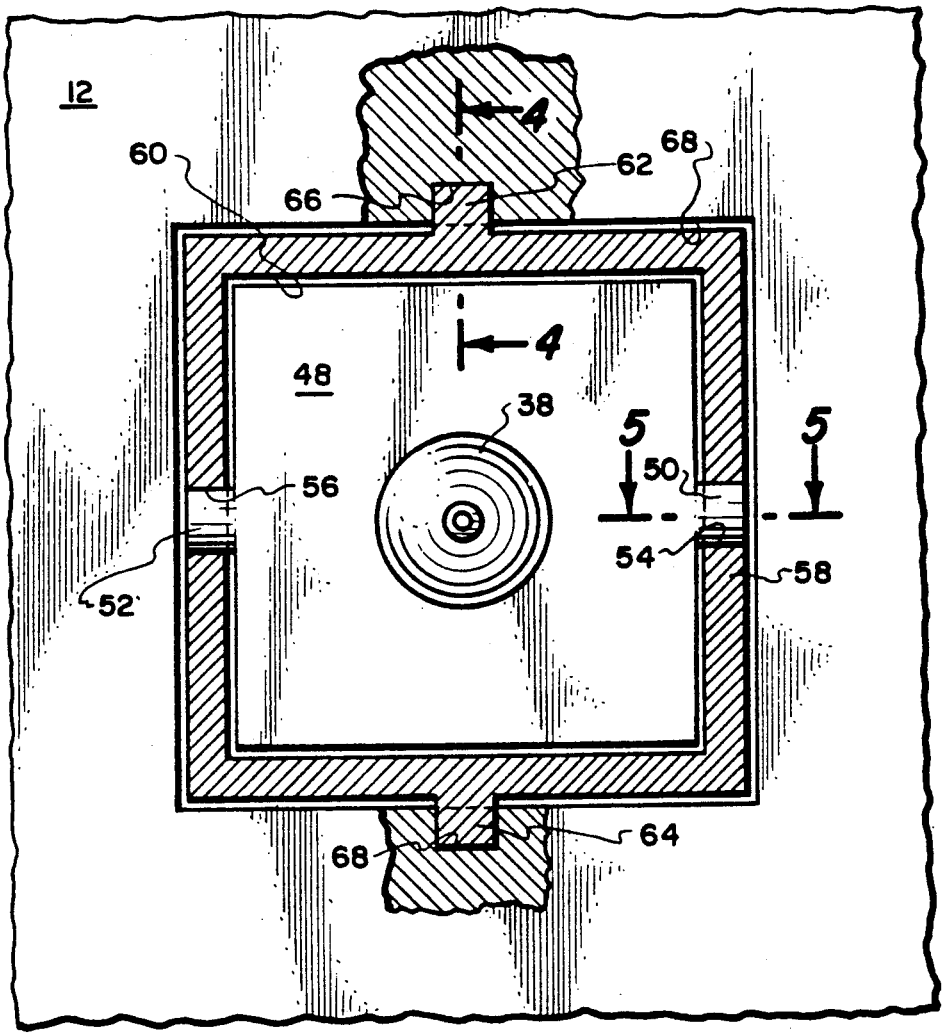
FIG. 3 is an enlarged exterior elevational view of a portion of the closing sidewall within which has been mounted an ultrasonic transducer which is supported by a gimbal arrangement which is different than the arrangement shown in FIG. 1.
Figure 4:
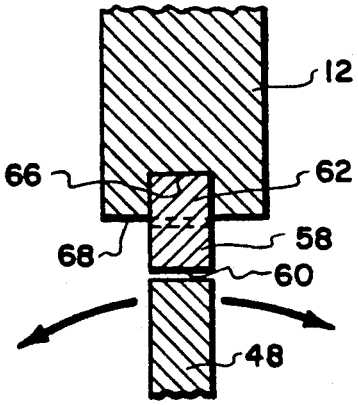
FIG. 4 is a cross-sectional view taken along line 4—4 of FIG. 3.
Figure 5:
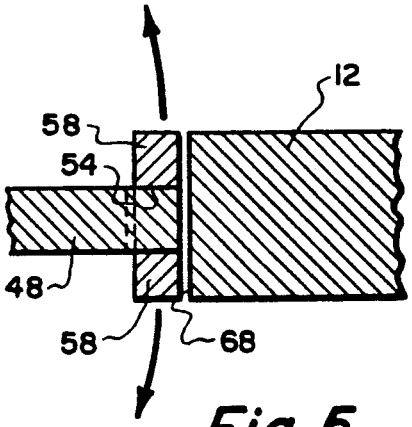
FIG. 5 is a cross-sectional view taken along line 5—5 of FIG. 4.

Referring particularly to FIGS. 3, 4 and 5 of the drawings, there is shown a modification of transducer mounting wherein the transducer 38 is fixedly mounted within a rectangularly shaped mounting plate 48. Extending from opposite sides of the plate 48 are pins 50 and 52. The pins 50 and 52 are in alignment with the middle of the plate 48. the pins 50 and 52 are low-frictionally located within respective holes 54 and 56 of a rectangularly shaped ring 58. The ring 58 defines a rectangularly shaped enlarged opening 60. Within this enlarged opening 60 is mounted the plate 48 with the perimeter of the plate 48 being slightly spaced from the ring 58. Ring 58 also includes a pair of pins 62 and 64 with these pins 62 and 64 being in alignment with the middle of the mounting plate 48. It is to be noted that the pins 62 and 64 are located along a vertical axis while the pins 50 and 52 are located along a horizontal axis. The pins 62 and 64 are respectively mounted within holes 66 and 68 formed within the sidewall 12 of the container 10. The ring 58 is slightly spaced from an enlarged opening 68 formed within the sidewall 12.

The primary advantage to the transducer mounting arrangement shown in FIGS. 3, 4 and 5 of the drawings is as energy is emitted from the transducer within the bath, the transducer 38 is free to move or wobble slightly within certain limits. These limits are to be defined by some means (not shown) so that tip 44 of the transducers 38 is always pointing in a direction within the confines of the interior chamber 14. This random free wobbling, which is referred hereto as "to nutate" or "nutation", is to permit the transducers 38 to disperse the energy over enlarged area of interior chamber 14 rather than a small directed area. In other words, when using the transducer mounting arrangement of FIGS. 3, 4 and 5, there is no need to have the tips 44 of the transducers point in a selected location. In essence, the transducer arrangement of FIGS. 3, 4 and 5 is a gimbaling arrangement similar to what is commonly used in a gyroscope.

Figure 6:
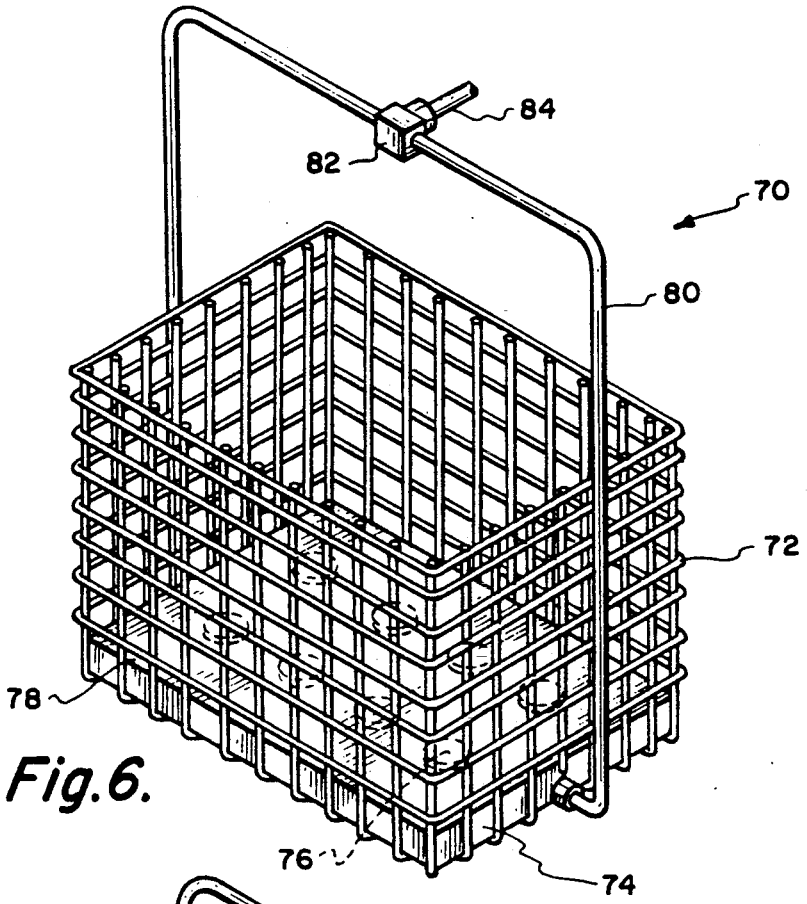
FIG. 6 is an isometric view of a basket type of parts container which is to be submerged within an ultrasonic cleaning bath.

Referring particularly to FIG. 6 of the drawings there is shown a modified form of parts container in the form of a basket 70 constructed of crossed thin tubular rods 72. It is to be understood that it is within the scope of this invention that the mesh of the rods 72 can be made larger or can be made smaller depending upon the particular installation. In other words, if it is expected that quite small parts are to be commonly cleaned, then the mesh of rod 72 would be "fine" so that the small parts could not fall freely from the basket 70. Of course when it is expected that larger parts are to be cleaned, the mesh of the basket 70 could be expanded.

Within the confines of the basket 70 forming the bottom thereof is a box-like container 74. Mounted within the box-like container 74 are a plurality of transducers 76. The transducers 76 are to be in contact with the uppermost wall 78 of the box 74. These transducers 76 are to drive the wall 78 which will cause the energy to be emitted therefrom in an upward direction toward the open top of the basket 70. This is the energy that will affect the cleaning of the parts contained within the basket 70.

The transducers 76 are to be electrically driven through appropriate electric wiring that is mounted within handle member 80. The handle member 80 is fixedly mounted to the box 74 at opposite ends thereof. The right side section and the left side section of the handle member 80 are connected together through a connector 82. The connector 82 connects to connecting conduit 84. Connector 82 is similar to connector 30 with connecting conduit 84 being similar to connecting conduit 32.

Figure 7:
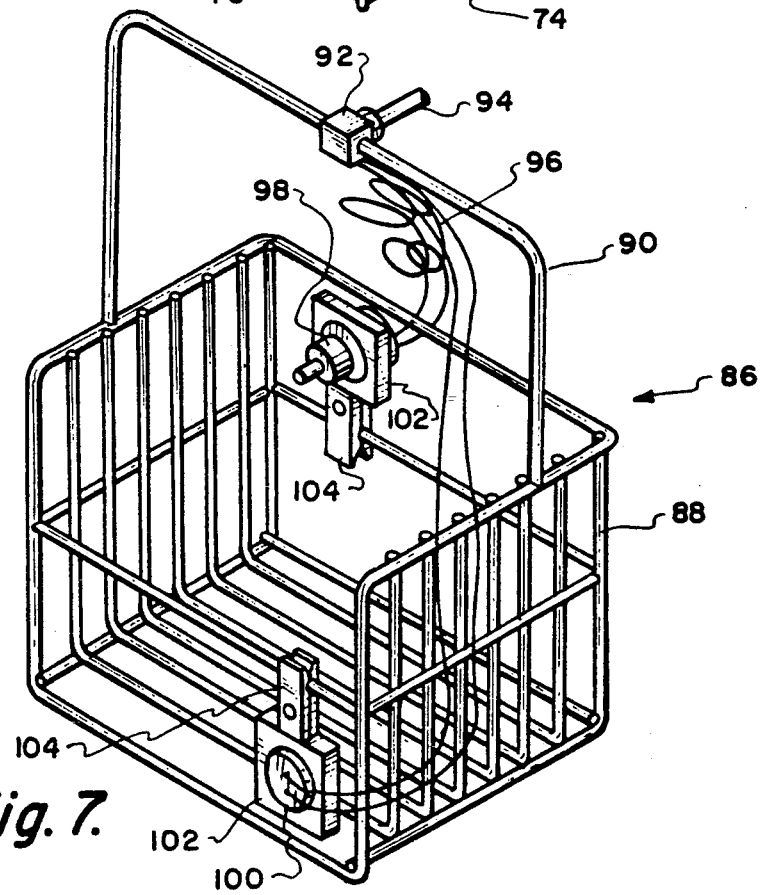
FIG. 7 is an isometric view of a basket type of parts container to which can be mounted at selected locations ultrasonic transducers.

Referring particularly to FIG. 7 of the drawings, there is shown a different form of basket 86. It is to be noted that the basket 86 is composed of a crossed pattern of metallic rods 88. It is to be noted that the mesh of the rods 88 is larger so that the basket 86 is designed to accommodate only relatively large sized parts to be cleaned. Integrally connected to the rods 88 is a handle 90. Again, the right and left hand sections of the handle 90 are joined by a connector 92 which in turn is connected to a connecting conduit 94. However, the electrical wires 96 are not located within the handle 90 but instead are loosely connected to the transducers 98 and 100. Both the transducers 98 and 100 are identical and each are mounted within a mounting block 102. Each mounting block 102 is mounted onto a clothespin type of clamping mechanism 104. This clamping mechanism 104 is to be selectively mounted at a desired location onto one of the metallic rods 88 with two typical types of installation as being depicted within FIG. 7. It is to be understood that any desired installation could be utilized with the operating end of each of the transducers 98 and 100 pointing toward the volume confined by the basket 86. It is to be understood that other various positions of the transducers 98 and 100 could be utilized by the clamping members 104 other than what is specifically shown in FIG. 7.

What is claimed is:

1. A parts container adapted to be submerged in a bath with a cleaning solution, said parts container to minimize ultrasonic energy losses plus allow usage of non-toxic cleaning solutions, said parts container comprising:

a wire basket having an entry access opening at the top, said wire basket being formed by a crossed series of wire rods; and an ultrasonic transducer assembly being selectively mounted on a said wire rod, said ultrasonic transducer assembly to be positionable to direct the energy emitted therefrom to a specific area within the confines of said parts container, said ultrasonic transducer assembly being removably clamped onto a said wire rod of said parts container.

* * * * *